US011131276B2

(12) United States Patent
Carrera García et al.

(10) Patent No.: US 11,131,276 B2
(45) Date of Patent: Sep. 28, 2021

(54) HEAT EXCHANGER DEVICE FOR EGR SYSTEMS

(71) Applicant: Borgwarner Emissions Systems Spain, S.L.U., Vigo (ES)

(72) Inventors: Julio Abraham Carrera García, Vigo (ES); Clara Díaz Bóveda, Vigo (ES); José Manuel Pérez Rodríguez, Vigo (ES); Gonzalo Simó Cardalda, Vigo (ES); Felix López Ferreiro, Vigo (ES); Maria Isabel Mendez Calvo, Vigo (ES); Juan Luis Fernández Villanueva, Vigo (ES); Rodolfo Prieto, Vigo (ES)

(73) Assignee: Borgwarner Emissions Systems Spain, S.L.U.

( * ) Notice: Subject to any disclaimer, the term of this patent is extended or adjusted under 35 U.S.C. 154(b) by 0 days.

(21) Appl. No.: 17/106,724

(22) Filed: Nov. 30, 2020

(65) Prior Publication Data

US 2021/0164421 A1 Jun. 3, 2021

(30) Foreign Application Priority Data

Nov. 29, 2019 (EP) ..... 19383062

(51) Int. Cl.
*F02M 26/32* (2016.01)

(52) U.S. Cl.
CPC ..... *F02M 26/32* (2016.02)

(58) Field of Classification Search
CPC ..... F02M 26/32
See application file for complete search history.

(56) References Cited

U.S. PATENT DOCUMENTS

2008/0047685 A1* 2/2008 Kim ..... F02M 26/32 165/52
2010/0243220 A1* 9/2010 Geskes ..... F02M 26/32 165/133
2013/0327499 A1* 12/2013 Goncalves ..... F02M 26/32 165/85
2015/0260466 A1* 9/2015 Grande Fernandez ... F28F 9/22 165/159
2015/0292804 A1* 10/2015 Hermida Dominguez ..... F28F 21/084 165/167
2015/0330712 A1* 11/2015 Losada ..... F02M 26/26 165/103
2016/0061535 A1 3/2016 Tomita et al.
(Continued)

FOREIGN PATENT DOCUMENTS

EP 2725219 A1 4/2014
EP 2728155 A1 5/2014
(Continued)

*Primary Examiner* — Xiao En Mo
(74) *Attorney, Agent, or Firm* — Lerner, David, Littenberg, Krumholz & Mentlik, LLP

(57) ABSTRACT

The present invention relates to a heat exchanger device for EGR ("Exhaust Gas Recirculation") systems, with a constructive solution which minimizes thermal fatigue when boiling occurs. The invention is characterized by a specific configuration of the inner space of the shell divided into a first exchange sub-space and a second degassing space communicated with one another, and wherein the inlet and outlet ports are located at the end where the cold baffle is located.

15 Claims, 7 Drawing Sheets

(56) References Cited

U.S. PATENT DOCUMENTS

2016/0370131 A1* 12/2016 Hermida Dom Nguez ..... F28D 7/16
2017/0336147 A1* 11/2017 Dieguez Fortes .... F28D 7/1684

FOREIGN PATENT DOCUMENTS

EP 2746561 A1 6/2014
WO 2011061090 A2 5/2011

* cited by examiner

HEAT EXCHANGER DEVICE FOR EGR SYSTEMS

CROSS-REFERENCE TO RELATED APPLICATIONS

The present application claims priority to European Patent Application Serial No. EP19383062.7, filed Nov. 29, 2019, the disclosure of which is hereby incorporated herein by reference.

OBJECT OF THE INVENTION

The present invention relates to a heat exchanger device for EGR ("Exhaust Gas Recirculation") systems, with a constructive solution which minimizes thermal fatigue when boiling occurs.

The invention is characterized by a specific configuration of the inner space of the shell divided into a first exchange sub-space and a second degassing space communicated with one another, and wherein the inlet and outlet ports are located at the end where the cold baffle is located.

BACKGROUND OF THE INVENTION

One of the fields of the art with the most intensive development is the field of heat exchangers intended for EGR systems in internal combustion engines, in which space requirements in the engine compartment call for the device to have the smallest possible size, maintaining the high rates of transferred heat.

Likewise, the high-performance requirements for internal combustion engines call for operating at high temperatures which give rise to very high exhaust gas temperatures in the inlet of the heat exchanger.

The heat exchange process from the hot exhaust gas to the liquid coolant causes the temperature of the gases to drop from the inlet to the outlet, such that the materials and attachments directly exposed to the inlet gases are those which are subjected to more extreme temperature conditions, so these parts break down sooner and must therefore be more protected to prolong the service life of the device as much as possible.

The structure of the most common heat exchanger is configured by means of an exchange tube bundle located between two end baffles with a shell housing the tube bundle. The hot gas goes through the inside of the exchange tubes of the tube bundle and the liquid coolant circulates between the outer surface of the exchange tubes and the shell.

The more efficient heat exchange is, the more the temperature of the gas is reduced, bringing the temperature to values at which the materials suffer less.

Heat exchange occurs in the wall separating the hot gas and the liquid coolant, i.e., mainly on the surface of the exchange tubes and also on the surface of the inlet baffle of the hot gas on which said gas incides directly. This baffle has, on one side, the hot exhaust gas inciding against it directly, and on the other side, the liquid coolant, except in locations where the tubes for the passage of gas are inserted.

When the temperature of any of the exchange surfaces exceeds the boiling temperature of the liquid coolant, the liquid coolant starts to form small bubbles which are transported by the main liquid coolant flow. It is the phase in which boiling starts.

The temperature and pressure conditions of the liquid coolant transporting the bubbles will determine either the expansion or the reduction of the diameter of the bubble, even the collapse thereof.

When in a specific heat exchange region the heat evacuated by the liquid coolant is not sufficient, the temperature of the exchange surface in contact with the liquid coolant increases, and as a result, several phenomena occur simultaneously on said exchange surface:

- the discrete points at which bubbles are generated become more numerous,
- the existing bubble generating points generate a larger number of bubbles, and
- the generated bubbles have a larger size.

When these phenomena associated with boiling are on the rise with the increase in temperature, there comes a time when a region completely covered by vapor is generated on the heat transfer surface due to the generation of bubbles creating a vapor layer. The vapor has a much lower coefficient of heat transfer than liquid, so the heat flow from the hot gas to the liquid coolant is drastically reduced at that time because the thermal resistance of the vapor layer is very high.

The reduction of heat transfer from the hot gas to the liquid coolant causes the temperature of the transfer surface to rise suddenly close to the temperature of the hot gas instead of being close to the temperature of the liquid coolant, giving rise to dilatations with its subsequent stresses and damage to the material.

These extreme effects are observed mainly on the heat exchange surfaces where the temperature of the gas is higher, i.e., in the baffle located on the hot gas inlet side. For this purpose, in order to reduce boiling effects, according to the state of the art the liquid coolant inlet is established on the side in which the baffle receiving the hot gas is located in order to prevent this baffle, which is subjected to the exhaust gas with a higher temperature, from receiving the liquid coolant at a lower temperature.

After covering the tube bundle removing heat, the liquid coolant exits through the opposite side, i.e., the side where the baffle, through which the exhaust gases exit once they are cooled, is located.

The engine compartment packing requirements sometimes call for the liquid coolant inlet and outlet conduits to be positioned at the same end of the heat exchanger.

In these cases, the liquid coolant inlet and outlet conduits with respect to the device are located at the end where the cold baffle, through which cooled exhaust gases exit, is located. In these specific modes of heat exchanger design, there is a conduit or channel which transports the liquid coolant that just enters the heat exchanger to the opposite end so that it first cools the hot baffle, the one located in the hot gas inlet, and then circulates in co-current until reaching the second liquid coolant outlet conduit.

Even with these precautions, current heat exchangers present various problems that are identified below.

The first problem is the existence of stagnation regions close to the hot baffle, the baffle associated with the end through which hot gas enters the tube bundle. If the conduit introducing the liquid coolant into the shell is located on one side, the opposite side gives rise to a corner in which the speed is zero or extremely low. The low speeds, and particularly the stagnation regions, do not remove the liquid coolant the temperature of which gradually increases due to the heat of the exchange surface. The temperature of this region increases constantly until reaching boiling. Furthermore, once boiling is reached, since it is a stagnation region, there are also no means for removing the generated vapor.

The known main mechanisms are those for increasing the speed in the areas close to the stagnation regions by placing the liquid coolant inlet as close as possible, given that the direct inlet of the inlet conduit of the liquid coolant has higher flow speeds.

The second identified problem is the removal of the bubbles generated during boiling. These bubbles tend to accumulate and if the region where they accumulate is also extensive, then they cannot be evacuated and will increase the problem of establishing areas in direct contact with the gas which reduce the heat transfer rate due to the effect of the generated vapor layer.

The present invention effectively solves the problems being considered by establishing a configuration which places various elements of the heat exchanger under conditions contrary to that established in the teachings of the state of the art.

BRIEF SUMMARY OF THE INVENTION

The present invention relates to a heat exchanger device for EGR systems wherein, in the operative mode, the heat exchanger is configured for transferring heat from a first fluid, a hot gas, to a second fluid, a liquid coolant. The hot gas is the exhaust gas of an internal combustion engine.

The exchanger comprises:

- a first baffle;
- a second baffle;
- a tube bundle with a first inner space for the passage of the first fluid, the hot gas, extending along a longitudinal direction X-X' between the first baffle and the second baffle, wherein a first end of the tube bundle is attached to the first baffle and a second end of the tube bundle, opposite the first end, is attached to the second baffle, and wherein the first end of the tube bundle is configured for receiving the hot gas and the second end of the tube bundle is configured for the exit of the cooled gas;
- a shell housing the tube bundle, establishing a second space between the tube bundle and said shell for the passage of a liquid coolant which, in the operative mode, covers the tubes of the tube bundle;
- a first inlet port for the entry of the liquid coolant to the second space of the inside of the shell;
- a second outlet port for the exit of the liquid coolant from the second space of the inside of the shell.

The configuration of the heat exchanger extends along a longitudinal direction X-X' in which there is a hot end where the inlet of hot exhaust gases is established, and a cold end, the opposite end, through which the gases exit once they are cooled.

The hot gas reaches the first baffle, wherein this first baffle will be identified as the hot baffle, so as to go to the inside of the exchange tubes of the tube bundle. The gas is transported through the inside of the heat exchange tubes, giving off its heat to the inner surface of the wall of the tubes. The gas, once cooled, exits to the outside by going through the second baffle.

The tube bundle is housed in a shell. The liquid coolant flows through the inside of the shell, covering the outer surface of the wall of the tubes. It is on this outer surface where heat exchange between the tubes of the tube bundle and the liquid coolant is established, and where boiling also occurs if the temperature and pressure conditions establish same.

Therefore, the gas circulates through the inside of the exchange tubes of the tube bundle, with this inner space being identified as the first space. The liquid coolant circulates through a second space, the space demarcated by the outer wall of the exchange tubes and the shell. The boiling effects occur in the second space.

Additionally:

- the first inlet port and the second outlet port are located at the end of the second space, according to the longitudinal direction X-X', corresponding to the second baffle;
- the shell houses a separator extending according to the longitudinal direction X-X', dividing the second space into a first heat exchange sub-space wherein the tube bundle is housed and a second degassing sub-space;
- the first inlet port is in fluid communication with the first sub-space and the second outlet port is in fluid communication with the second sub-space,
- wherein the first sub-space and the second sub-space are in fluid communication through at least one opening located, according to the longitudinal direction X-X', at the end corresponding to the first baffle, and
- wherein in the operative mode the flow of the second fluid in the first sub-space is in counter-current with respect to the flow of the first fluid.

The presence of a separator located in the second space, the inner space of the shell, defines two sub spaces: a first sub-space intended for housing the tube bundle, and therefore it is a space where heat exchange occurs, and a second sub-space without exchange tubes which determines this second space as a degassing space.

In contrast to what has been established in the state of the art, the inlet port of the liquid coolant is established at the end opposite where the first baffle, the baffle directly receiving the hot gas, is located. With this configuration, the first inlet port establishes the entry of the liquid coolant into the first sub-space but at the end where the second baffle, the cold baffle, is located. It must be indicated that, when it is established in the state of the art that the liquid coolant enters the heat exchanger at the end where the cold baffle is located, the entry is not into the first sub-space where the exchange tubes are located, but rather into an inner conduit or channel which first conducts the liquid coolant to the hot baffle so that entry into the heat exchange sub-space can occur at this end.

In addition to this position of the inlet port, the outlet port is located in communication with the second sub-space for the exit of the liquid coolant housed in said sub-space.

The communication between the first sub-space and the second sub-space is through an opening located, according to the longitudinal direction X-X', at the end corresponding to the first baffle. This relative position together with the preceding conditions determines a specific configuration of the liquid coolant flow.

The liquid coolant enters the first sub-space through the end of the heat exchanger, according to the longitudinal direction X-X', where the second baffle is located, and generates a counter-current flow with respect to the direction of the gas flow until reaching the first baffle. The first baffle is cooled with the liquid coolant after heat exchange with the tube bundle has occurred, and therefore at a higher temperature than what is established in the state of the art with the co-current configuration.

After having covered the tube bundle and the first baffle, the liquid coolant flow goes to the second sub-space along which it must run until reaching the outlet port.

Although it is considered in the state of the art that the first baffle, the one subjected to the direct action of the hot gas, is where the liquid coolant inlet must be located in order to minimize the boiling effect, the numerical simulation of the flow in a heat exchanger according to the invention has surprisingly shown that the temperature of the first baffle is lower in a counter-current configuration because the liquid coolant flow is more homogeneous, cooling the hotter areas better and without vapor chambers being formed due to bubble accumulation, in comparison with similar configurations using a co-current configuration like that of the state of the art.

The first effect that has been observed is that the entry of the liquid coolant into the tube bundle without having first passed close to the first baffle, i.e., the hotter baffle, gives rise to a more homogenous temperature distribution in the spaces between the tubes of the tube bundle. Given that the flow is a counter-current flow, the temperatures gradients are smoother and the generation of bubbles due to the boiling effect is less and these bubbles are readily transported, being efficiently removed from the exchange surface given that the connection between the first sub-space and the second sub-space is close to the area where more bubbles are generated, i.e., the first baffle or hot baffle.

These bubbles are transported until reaching the second sub-space that is free of exchange surfaces, so it has been observed that the bubbles have to be transported along a distance equivalent to the length of the heat exchanger in a region where heat is not provided, so these bubbles collapse, at least for the most part, preventing accumulation and being readily entrained by the main liquid coolant flow.

Furthermore, since the main inlet of the liquid coolant in the second sub-space is at one end and the outlet of the same sub-space is at the opposite end, the flow entrains all the bubbles during the collapse process and there are no stagnation regions where vapor can accumulate.

The second effect that has been observed in the present invention is that, contrary to what was expected, the cooling of the first baffle is more efficient, although the liquid coolant reaching said baffle is at a higher temperature than the inlet temperature in the inlet port of the liquid coolant. Simulations have shown that the entry of the liquid coolant at the opposite end homogenizes the strongly oriented flow of the inlet port and leads to the presence of a flow parallel to the first baffle sweeping any stagnation area until evacuating the liquid coolant through the opening for communication with the second sub-space. Therefore, any exchange surface where bubbles are generated, which is subjected to the highest temperature, is better cooled even when the position of the inlet port has been moved away with respect to the longitudinal direction X-X'.

According to a first embodiment, the separator establishing separation between the first sub-space and the second sub-space has one or more communication windows along direction X-X'. It has been observed that with these communication windows, the main configuration of the liquid coolant flow is maintained, moreover the exit of the bubbles which are generated in the tube bundle is facilitated, as these bubbles are not forced to go through a single opening, maintaining a greater separation between bubbles and preventing these bubbles from coming together, giving rise to bubbles with a larger size. Since these bubbles are maintained at a smaller size, they collapse and disappear, at least for the most part, upon entering the second degassing sub-space. According to another preferred example, the size of these windows is smaller than the size of the fluid communication opening between the first sub-space and the second sub-space located at the end corresponding to the first baffle.

According to a third embodiment, between the separator and the second baffle there is a small separation which prevents contact with the separating wall, and therefore thermal fatigue effects. It has been observed that the amount of flow going from the first sub-space to the second sub-space, in order to prevent contact between parts, is not detrimental to the described operation.

BRIEF DESCRIPTION OF THE DRAWINGS

These and other features and advantages of the invention will become more apparent based on the following detailed description of a preferred embodiment, given solely by way of non-limiting illustrative example in reference to the attached figures.

DETAILED DESCRIPTION

According to the first inventive aspect, the present invention relates to a device for heat exchange in EGR systems wherein the temperature of a portion of the hot gas, identified as first fluid, coming from the combustion chamber, must be reduced in order to be able to be reintroduced into the intake, thereby reducing the nitrogen oxide content in the exhaust.

The described heat exchange device has said purpose, wherein heat from the first fluid is given off to a second fluid, the liquid coolant.

The described embodiments solve the problems already identified as being caused by the boiling of the liquid coolant which is in contact with the hotter surfaces where heat exchange occurs, particularly in the baffle directly receiving the hot gas.

Figure 1:
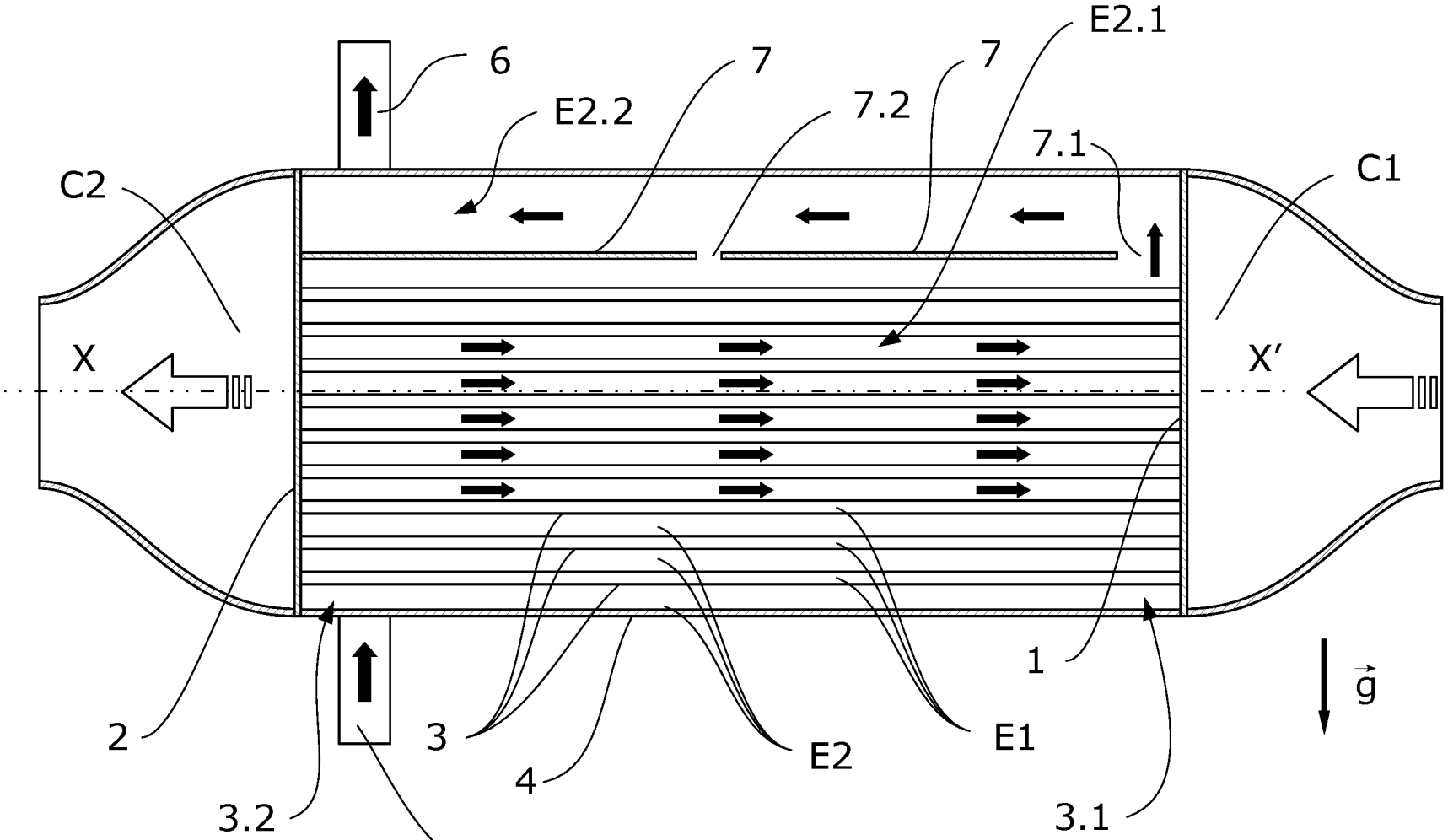
FIG. 1 schematically shows a longitudinal section of a first embodiment.

FIG. 1 is a schematic figure of a first embodiment of the invention depicting a longitudinal section of the heat exchanger according to this first example.

The heat exchanger comprises a hot gas inlet, wherein in this embodiment the inlet is configured by means of an inlet manifold (C1) located on the right-hand side of the drawing. The flow of the hot gas is depicted by a large, hollow arrow. According to other embodiments, the coupling of the heat exchanger with other devices located upstream of the gas flow, such as a filter or a catalytic converter, can be direct coupling without using a manifold.

After traversing the heat exchanger giving off part of its heat, the cooled gas exits through an outlet manifold (C2)

located on the left-hand side of the same drawing. The flow of the cooled gas is also depicted with a large, hollow arrow. Likewise, according to other embodiments the coupling with other elements located downstream of the gas flow can be direct coupling without using a manifold.

The direction of advancement of the gas from the inlet manifold (C1) to the outlet manifold (C2) defines a longitudinal direction X-X'.

There is located between the inlet manifold (C1) and the outlet manifold (C2) the region where heat exchange is established, limited between a first baffle (1), the baffle which will be identified as the hot baffle as it is the one which directly receives the hot gas, and a second baffle (2), the baffle which will be identified as the cold baffle as it is located where gas that has been cooled exits.

The exchange region also comprises a tube bundle (3) responsible for heat exchange between the first fluid and the second fluid. The tube bundle (3) extends between the first baffle (1) and the second baffle (2), wherein a first end (3.1) of the tube bundle (3) is attached to the first baffle (1) and a second end (3.2) of the tube bundle (3), opposite the first end (3.1), is attached to the second baffle (2), and wherein the first end (3.1) of the tube bundle (3) is configured for receiving the hot gas and the second end (3.2) of the tube bundle is configured for the exit of the cooled gas. The tube bundle (3) also defines two spaces, a first inner space (E1) for the passage of the first fluid, the hot gas, and a second outer space (E2) through which the second fluid, the liquid coolant, circulates.

The tube bundle (3) is housed in a shell (4) which closes the second space (E2) outside the tubes of the tube bundle (3).

This same FIG. 1 shows this second space (E2) outside the tube bundle (3). It is in turn sub-divided into two sub-spaces by means of a separator (7) extending according to the longitudinal direction X-X': a first heat exchange sub-space (E2.1) in which the tube bundle (3) is housed, and a second sub-space (E2.2) which is identified as a degassing space in this description.

The same drawing depicts the direction of gravity ($\vec{g}$) by means of an arrow vertically oriented according to the orientation of the drawing. The longitudinal direction in this embodiment is therefore horizontal with respect to the direction of gravity.

Following the reference of gravity, the first heat exchange sub-space (E2.1) is located in the lower part and the second degassing sub-space (E2.2) is located in the upper part. In all the examples described in the description, the second sub-space (E2.2) being above the first sub-space (E2.1) according to the direction established by the action of gravity is considered a preferred feature. The action of gravity is relevant. Bubbles are always generated on a surface where heat is being given off to the liquid coolant and this point reaches temperature and pressure conditions such that they give rise to boiling.

The surfaces where heat is given off to the liquid coolant are:

- the outer surfaces of the tubes of the tube bundle (3),
- the surface of the first baffle (1) in contact with the liquid coolant, and
- to a lesser extent, the surface of the second baffle (2) in contact with the liquid coolant if the required temperature and pressure conditions arise.

Boiling occurs mainly on the first two surfaces. The generated bubbles tend to move up by flotation, hence the first heat exchange sub-space (E2.1) has been located in the lower part and the second degassing sub-space (E2.2) in the upper part according to the direction of gravity ($\vec{g}$).

The entry of the liquid coolant occurs through a first inlet port (5) located on the side depicted on the left-hand side in FIG. 1, the side corresponding to the end where the second baffle (2) or cold baffle is located. The liquid coolant covers the tubes of the tube bundle (3), removing heat. The flow of the liquid coolant initially shows a flow distribution at the inlet thereof that tends to occupy all the available space according to the cross-section, and it then moves in counter-current according to the longitudinal direction X-X' to the first baffle (1), the hot baffle.

It has been proven by means of numerical simulation that the liquid coolant shows a more uniform temperature distribution in the specific configuration being described than a co-current configuration, such that the greater temperature uniformity minimizes the appearance of points that stand out with a higher temperature than the rest of the points located nearby, preventing the appearance of preferred points where bubbles are generated due to boiling.

Likewise, when the liquid coolant reaches the first baffle (1), there is established a transverse flow, understood as being perpendicular to the longitudinal direction X-X', which keeps to the surface of the first baffle (1) until exiting through an opening (7.1) communicating the first heat exchange sub-space (E2.1) in the lower part and the second degassing sub-space (E2.2) of the upper part, minimizing the presence of stagnation areas.

In the preferred embodiment, the opening (7.1) is configured by a separation between the separator (7) and the first baffle (1), giving rise to a flow which keeps to said first baffle (1) as much as possible.

Stagnation areas are areas with zero or almost zero flow speed. Stagnation areas where liquid coolant are present and which are limited by surfaces where heat is given off from the hot gas to the liquid coolant are areas where the liquid coolant is constantly receiving heat with an increase in temperature, so boiling is inevitable. Furthermore, since there are no transport mechanisms in the fluid, the vapor generated by boiling is not removed either, giving rise to large spaces with vapor instead of liquid. If this space occupied by the vapor also corresponds to the surface where heat is given off, the heat transfer rate decreases and the temperature in the material where the surface is located is increased even more, drastically increasing thermal stresses.

With the described configuration, it has been verified that there are no stagnation areas, and the bubbles which are generated on the surface of the first baffle (1) move up both by flotation and by convection of the transverse flow to the opening (7.1), and all these bubbles are therefore evacuated.

The bubbles evacuated through the opening (7.1) are transported through the second sub-space (E2.2) where there are no heat exchange surfaces, so it is observed that the size of the bubbles decrease significantly or the bubbles disappear altogether. Hence, this second sub-space (E2.2) has been identified as a degassing space in the description.

Finally, the liquid coolant flow reaches the second outlet port (6).

It must be pointed out that the most common tests evaluating the extent at which the heat exchanger is exposed to boiling phenomena carry out measurements in the outlet port (6) so, even though bubbles are generated, it is important for these bubbles to decrease or even collapse before the exit thereof, improving the overall behavior of the heat exchanger with respect to boiling.

Embodiments in which the longitudinal direction X-X' has a specific angle of inclination with respect to the horizontal direction are also considered. In the embodiment shown in FIG. 1, the angle of inclination is zero. Nevertheless, those embodiments in which the angle of inclination is in the range [0, 90), i.e., without reaching 90 degrees, are also considered.

The angle of inclination is considered positive when the position of the first baffle (1) is raised with respect to the second baffle (2).

In an inclined position with a positive inclination, some points of the first exchange sub-space (E2.1) are located above some points of the second degassing sub-space (E2.2); nevertheless, the described effects continue to be observed since the opening (7.1) communicating both sub-spaces (E2.1, E2.2) is shown at the higher point, allowing the passage of bubbles.

Furthermore, although some points of the first exchange sub-space (E2.1) are located above some points of the second degassing sub-space (E2.2), the center of masses of the volume defined by the first exchange sub-space (E2.1) is located below the center of masses of the volume defined by second degassing sub-space (E2.2). In other words, the first exchange sub-space (E2.1) is still considered as being below the second degassing sub-space (E2.2).

Likewise, those embodiments of the invention in which the angle of inclination is negative, specifically in the range [−40,0), are considered. It has been experimentally verified that in common operative conditions, although the position of the opening (7.1) communicating the first sub-space (E2.1) and the second sub-space (E2.2) is located at a lower point with respect to the rest of the points of the separator (7), the bubbles are entrained by the main flow although the bubbles will tend to float in counter-current when they reach the separator (7).

The same occurs when the angle is positive, the bubbles' tendency to float and therefore to move in the direction contrary to gravity can give rise to a backward movement component in the second sub-space (E2.2), nevertheless the flow speed overcomes this tendency and this is achieved to a greater extent in the second degassing sub-space (E2.2) with positive angles as the cross-section in this second sub-space (E2.2) is smaller than the cross-section in the first sub-space (E2.1), and therefore the flow speeds of the liquid coolant are greater.

FIG. 1 also shows the separator (7) with an additional opening (7.2) along the longitudinal direction X-X' that is different from the main opening (7.1) communicating the first exchange sub-space (E2.1) and the second degassing sub-space (E2.2).

Figure 2:
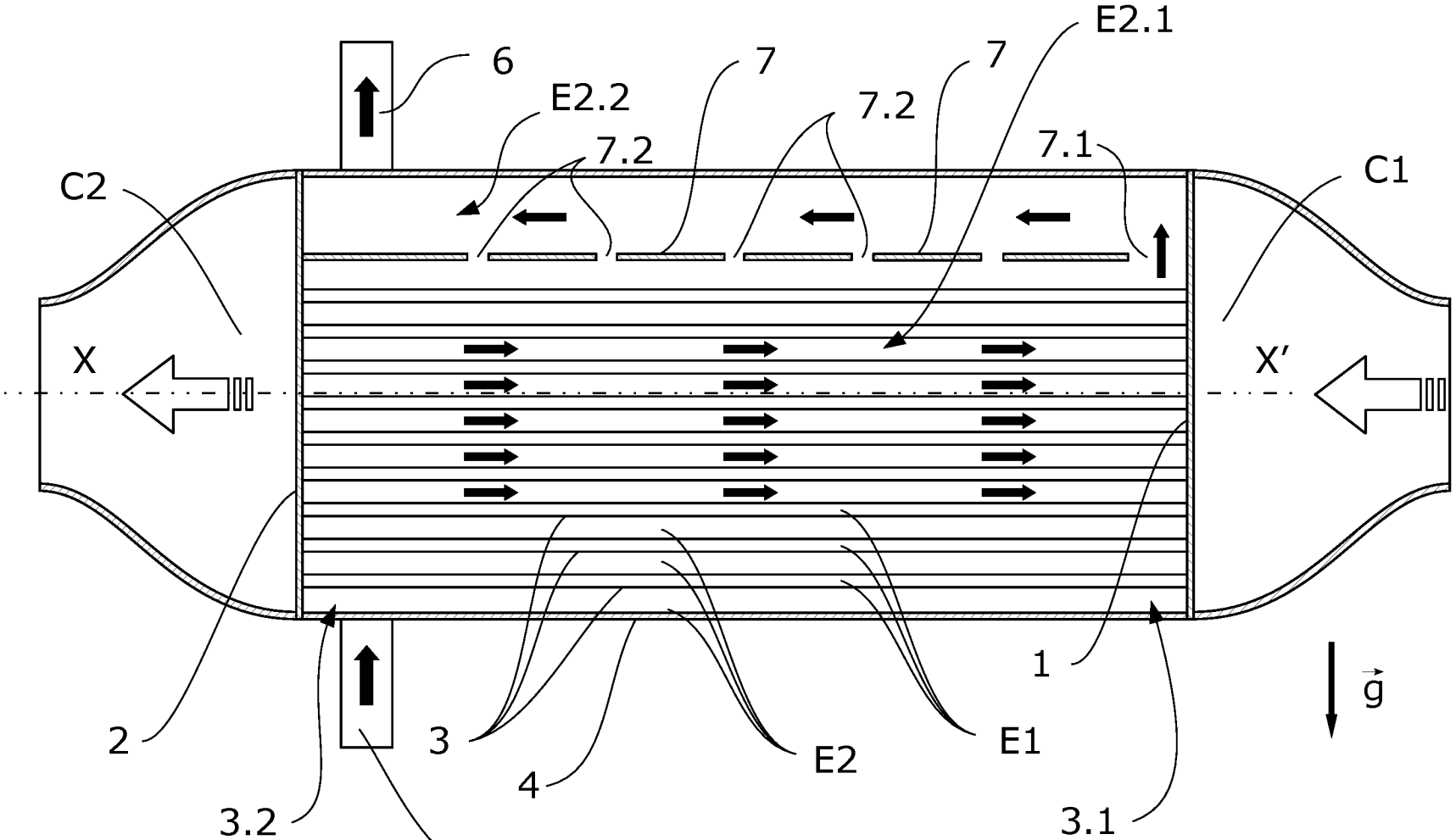
FIG. 2 schematically shows a longitudinal section of a second embodiment.

FIG. 2 shows another embodiment of the invention in which all the elements coincide with the first embodiment, with the exception that in this embodiment there is a plurality of additional openings (7.2) along the longitudinal direction X-X'.

This plurality of openings (7.2) allow the exit of the bubbles generated along the exchange tube bundle (3) given that these bubbles move up and find the passage towards the second degassing sub-space (E2.2) without having to run along the entire path to the first baffle (1) in order to exit through the main opening (7.1) located in this first baffle (1).

The amount of bubbles that accumulate to exit through this first main opening (7.1) is therefore also reduced. It has been verified that with additional openings (7.2) the second degassing sub-space (E2.2) still maintains a flow directed to the second outlet port (6) where the bubbles have a reduced size or collapse.

Figure 3:
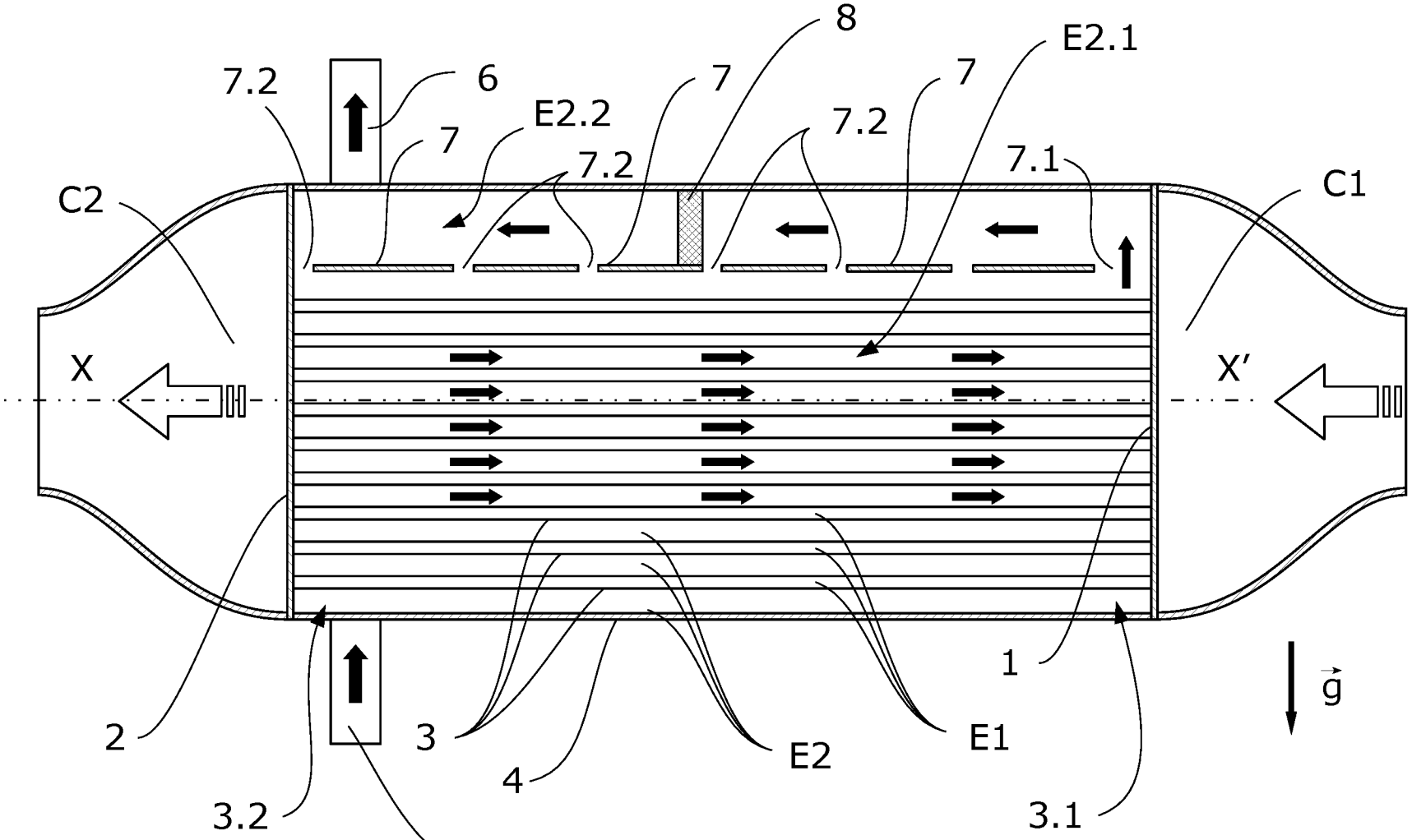
FIG. 3 schematically shows a longitudinal section of a third embodiment.

There is a possibility that a stagnation area may appear in the second degassing sub-space (E2.2), at its end in contact with the second outlet port (6). FIG. 3 shows a third embodiment in which an additional opening (7.2) has been added by means of distancing the separator (7) and the second baffle (2), allowing the passage of a small liquid coolant flow intended for preventing the appearance of stagnation or recirculation areas.

The same FIG. 3 is used to describe another embodiment which allows breaking the vapor bubbles before they exit the heat exchanger and which is applicable to any of the examples described up until now and below.

According to this embodiment, the second sub-space (E2.2) houses a porous element (8) which, although it allows the passage of the liquid coolant, forms narrow channels that either cause gas bubbles to break into other smaller bubbles or even to collapse, causing them to disappear.

The porous element (8) preferably covers the entire passage section of the second sub-space (E2.2) to force all the liquid coolant flow and bubbles to go through said porous element (8).

The porous element (8) must be interpreted in a broad manner as any material which allows passage through narrow fluid passage channels or paths. The materials suitable for allowing the passage of fluid and causing the bubbles to break or collapse include, among others:

- porous materials with their pores communicated with one another;
- compact fibers;
- meshes and/or specifically metallic meshes;
- metallic bands that are partially wound forming a ball and compacted into a bundle;
- a combination of any of the foregoing.

According to another embodiment, the second sub-space (E2.2) comprises a plurality of porous elements distributed consecutively along the longitudinal direction.

Figure 4:
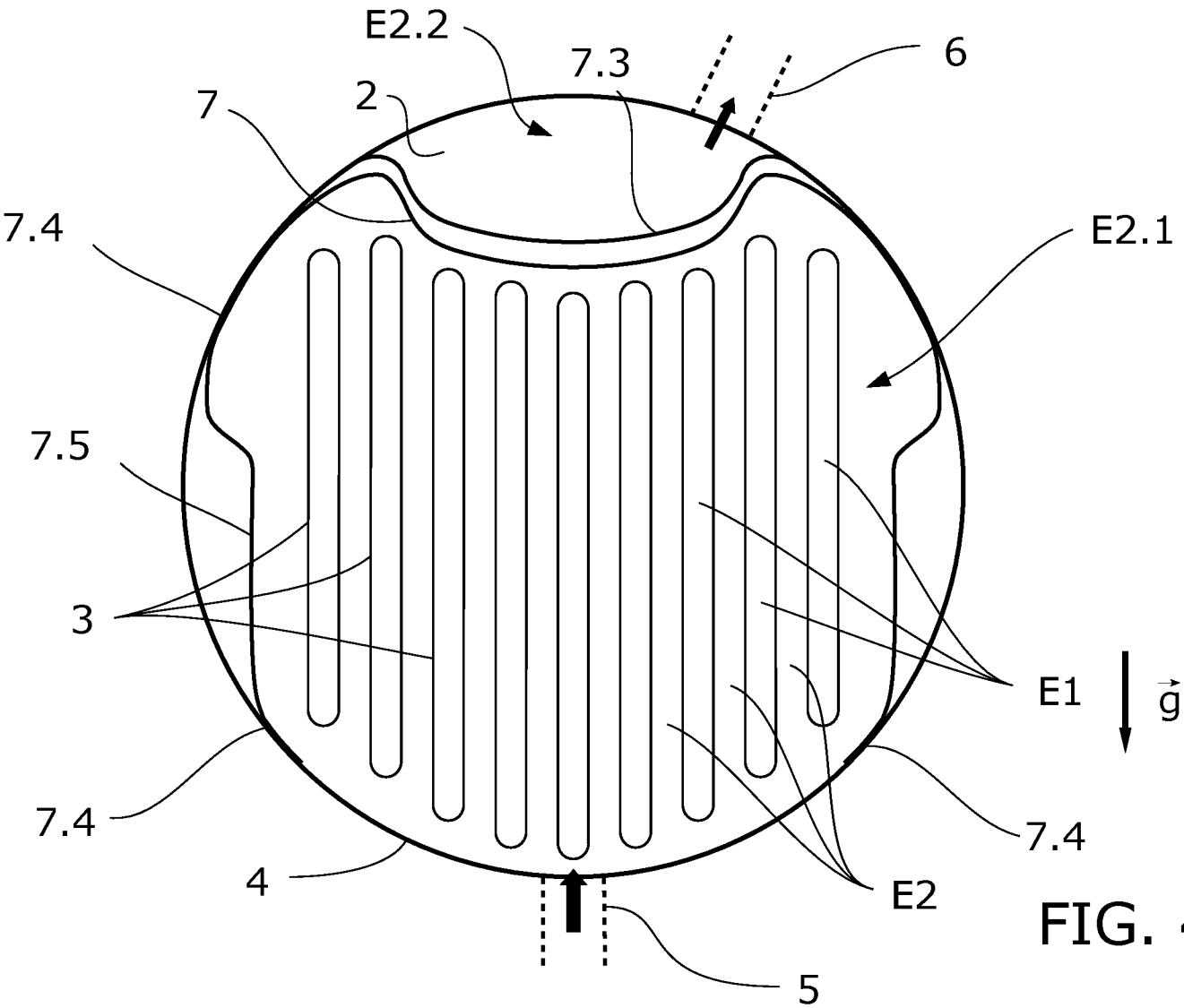
FIG. 4 schematically shows a cross-section of a fourth embodiment, wherein the heat exchanger has a circular cross-section.

FIG. 4 schematically shows a cross-section according to a fourth embodiment in which said cross-section is located close to the first baffle (1) to enable observing the inner spaces and the second baffle (2) where the inlet port (1) and the outlet port (2) are located.

This section does not allow observing the main opening (7.1) allowing the passage of the liquid coolant from the first exchange sub-space (E2.1) to the second degassing sub-space (E2.2) as it corresponds to the section that is eliminated to enable observing the inside of the heat exchanger.

This embodiment uses a shell (4) having a circular section and the separator (7) is formed by a bent sheet defining a first heat exchange sub-space (E2.1) in the lower part and a second degassing sub-space (E2.2) in the upper part. In this embodiment, the tubes of the tube bundle (3) are planar tubes vertically oriented to favor the upward movement of the bubbles generated on the exchange surfaces, being removed from the space between tubes (3) where heat exchange occurs.

In this embodiment, the separator (7) is only attached to the shell (4) and not to the first baffle (1) or the second baffle (2). The attachment with the shell (4) is established in two attachment segments (7.4), one in the upper part and another in the lower part on both sides.

The attachment of the part giving rise to the separator (7) has a first attachment segment (7.4) in the upper part and a second attachment segment (7.4) in the lower part, always according to the direction of gravity ($\vec{g}$), given that between both attachment segments (7.4) there is a segment (7.5) spaced from the shell (4) and kept to the tube bundle (3) to reduce the volume through which the liquid coolant passes outside the tube bundle (3), because otherwise, a preferred path with less resistance to the passage of the liquid coolant than that shown in the inside of the tube bundle (3) would be established, resulting in a greater liquid coolant flow speed in the inside of said tube bundle (3).

This same FIG. 4 shows a reduction in the passage section by means of a step (7.3) configured in the separator (7). It has been verified that the optimum conditions so as to not penalize pressure drop in the outlet flow are as follows:

$$S_p \leq S_d \leq S_h$$

where $S_p$ is the cross-section of the outlet port (6), $S_d$ is the cross-section of the second degassing sub-space (E2.2), and $S_h$ is the cross-section of the first exchange sub-space (E2.1).

It has been observed that the behavior of the heat exchanger with respect to pressure drop is better when one or both the inequalities are strict: "<".

When the outlet port (6), the second degassing sub-space (E2.2), or the first exchange sub-space (E2.1) have a variable section along the path of the fluid in the operative mode, then the value of the section is measured where said section is maximum. For example, if there is a stepping which changes the section in a segment, then the larger section is taken. The same occurs if a specific segment has projections, in this case the section to be measured will be the section taken without the projections.

Figure 5:
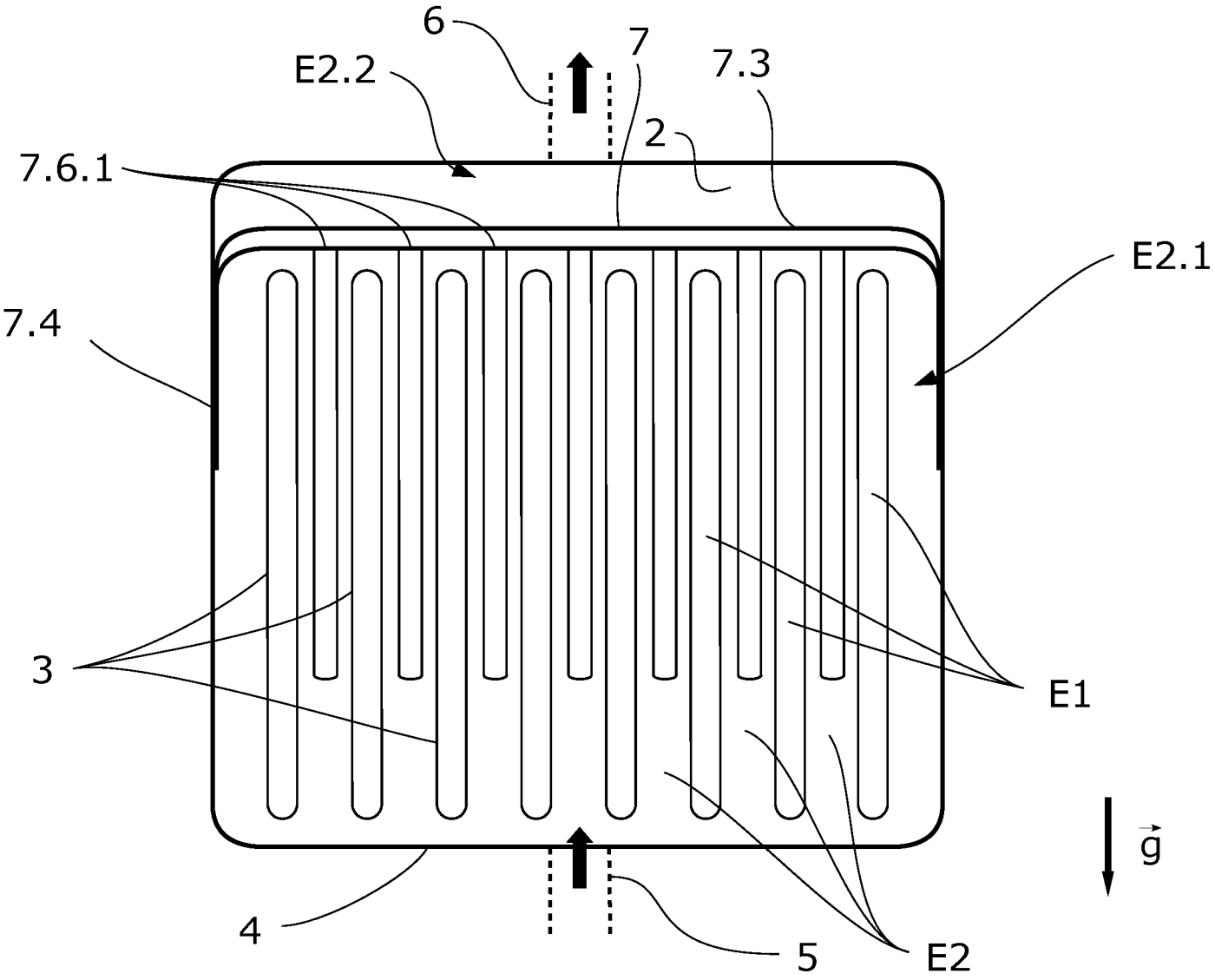
FIG. 5 schematically shows a cross-section of a fifth embodiment, wherein the heat exchanger has a rectangular cross-section.

FIG. 5 schematically shows, in a cross-section, a fifth embodiment in which said cross-section is of an essentially rectangular configuration. In this embodiment, the shell is configured with a rectangular section and allows all the tubes of the tube bundle (3) to have the same dimensions and to be equally distributed in the first heat exchange space (E2.1).

In this embodiment, the separator (7) is a planar plate dividing the first sub-space (E2.1) where the tube bundle (3) is housed and the second degassing sub-space (E2.2).

According to this embodiment, the two sides of the separator (7) extend into two perpendicular strips constituting respective attachment segments (7.4) which are supported on the inner wall of the shell (4) such that the separator (7) is attached to said wall by welding.

In this same embodiment, a step (7.3) which modifies the section of the second degassing sub-space (E2.2), reducing it before reaching the second outlet port (6), has been included.

In this embodiment, the separator (7) is made of a sheet and includes a plurality of partial U-shaped die-cuttings resulting in a tab (7.6) located in the inside of the "U" and a non-die-cut root (7.6.1) which keeps the tab (7.6) attached to the sheet of the separator (7). After die-cutting, each of the tabs (7.6) is bent in the root (7.6.1) thereof to orient the tab (7.6) perpendicular to the longitudinal direction X-X' of the heat exchanger.

In this embodiment, each tab (7.6) is positioned such that it is located between two tubes of the tube bundle (3) and the plurality of the tabs (7.6) define a single plane transverse to the longitudinal direction X-X' of the heat exchanger.

The technical effect of the presence of the plurality of tabs (7.6) is the configuration of a deflecting baffle which accelerates the liquid coolant flow. In this particular example in which the tabs are close to the first baffle (1), the liquid coolant is accelerated in the vicinities of said first baffle (1), improving its cooling.

This specific way of forming the tabs (7.6) by die-cutting the sheet forming the separator (7) simultaneously allows forming longitudinal grooves in the separator (7) which are openings (7.1) that facilitate the exit of the bubbles to the second degassing sub-space (E2.2). In other words, these openings (7.1) formed by the tabs (7.6) may co-exist with other openings (7.1) generated by other means.

The tabs (7.6) described in this embodiment are applicable to other configurations of the exchanger, specifically to the exchanger having a circular section described in the preceding embodiments.

Figure 6:
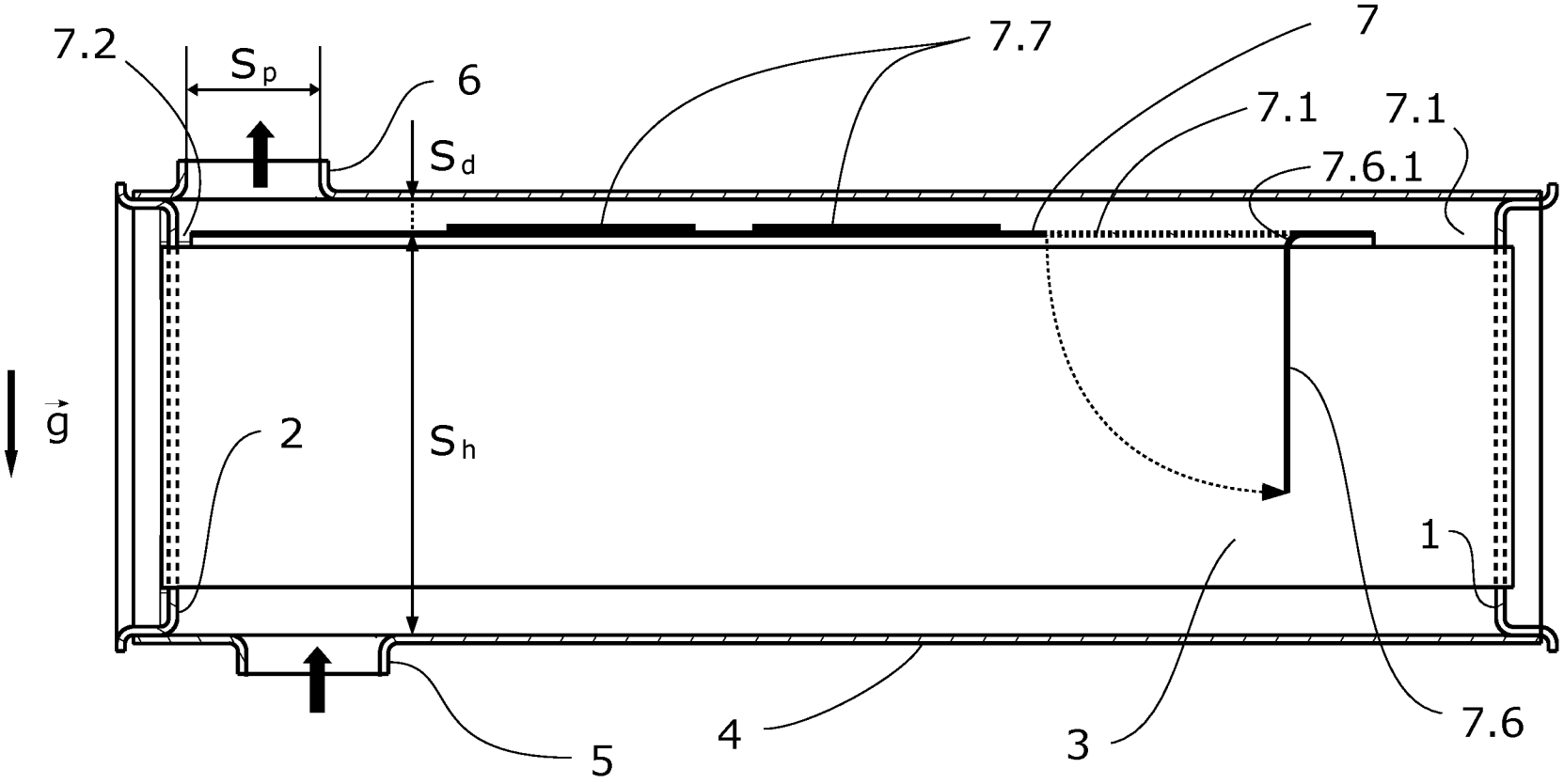
FIG. 6 schematically shows, according to a longitudinal section, a sixth embodiment based on the preceding embodiment with a shell having a rectangular section.

FIG. 6 shows a longitudinal section of a sixth embodiment which also uses tabs (7.6) like those described in the preceding embodiment. This section shows the direction of bending the tab (7.6) after die-cutting the sheet forming the separator (7) in order to form a surface parallel to the first baffle (1).

In this embodiment, in addition to the opening (7.2) generated by bending the tab (7.6), the opening (7.1) located adjacent to the first baffle (1) and the opening (7.1) having smaller dimensions established by means of distancing the wall (7) with the second baffle (2) are also obtained.

This same embodiment shows, in the separator (7), a set of protrusions (7.7) projected towards the second degassing sub-space (E2.2) which allow guiding the liquid coolant flow in this region. Specifically, in this embodiment the set of protrusions (7.7) has been configured like a labyrinth to increase the length the liquid coolant must circulate, favoring bubble size reduction or even causing the bubble to collapse.

Figure 7:
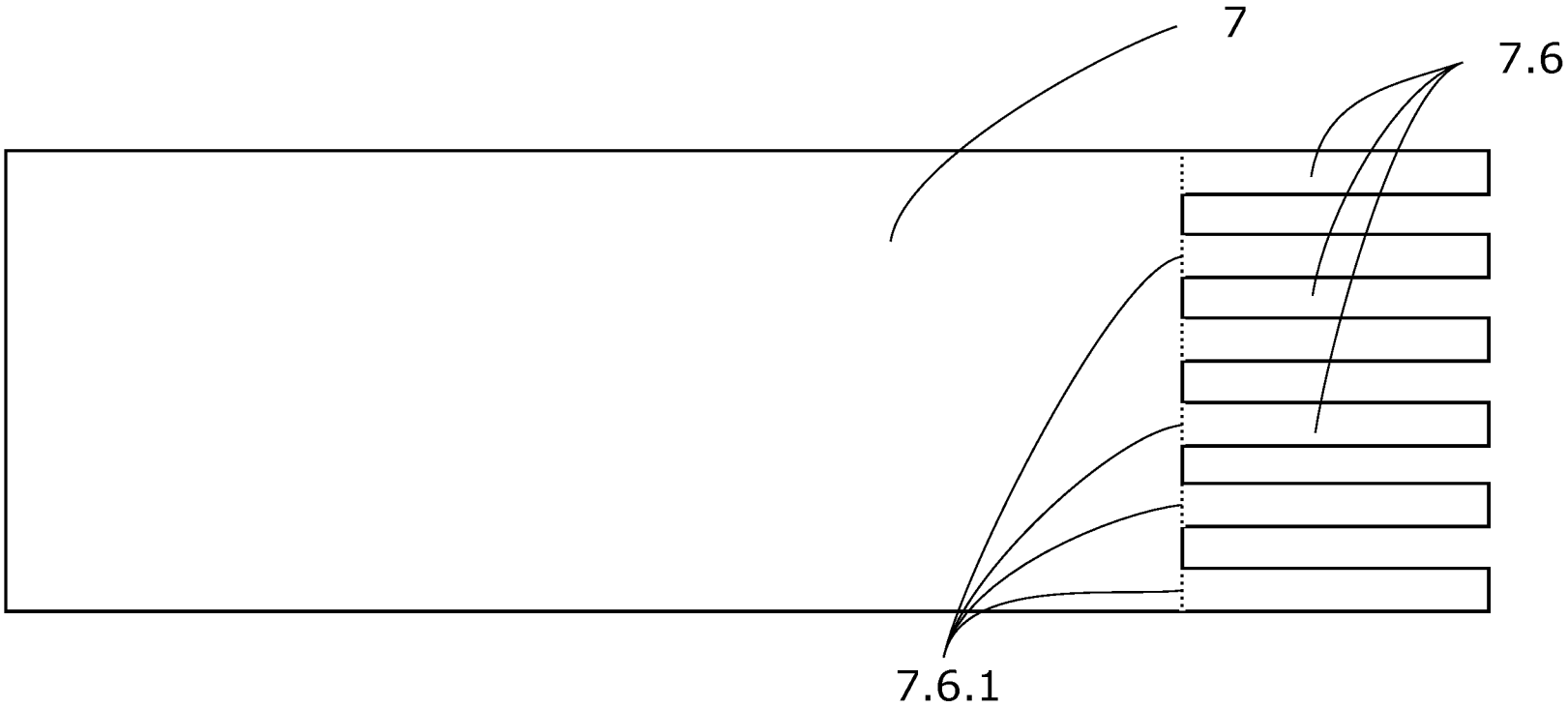
FIG. 7 schematically shows another embodiment of the separator shown with a pre-configuration before being bent to form flow deflectors.

Given that the same FIG. 7 is a longitudinal section, it has been depicted therein locations where the three sections also identified in a preceding embodiment have been measured:

$S_p$ the cross-section of the outlet port (6), $S_d$ the cross-section of the second degassing sub-space (E2.2), and $S_h$ the cross-section of the first exchange sub-space (E2.1).

FIG. 7 shows another embodiment applicable to any of the described heat exchangers, both in a configuration with a circular section and a rectangular section. In this embodiment, die-cutting configuring both the tab (7.6) and the openings (7.1) in the gaps left by said tabs (7.6) after being bent as described in the preceding embodiment does not have to be carried out.

According to this embodiment, the separator (7) is configured from a sheet wherein the tabs (7.6) are configured according to strips that are prolonged into an end of said sheet. A simple way of configuring these tabs (7.6) is by die-cutting the spaces between tabs (7.6), in this case rectangular parts, at the end of the sheet, leaving the tabs (7.6) as a result.

FIG. 7 shows the result of the sheet after the die-cutting operation and before carrying out the bending operation.

After die-cutting, the tabs (7.6) are bent through the transverse line located in the attachment root (7.6.1) between each tab (7.6) and the main plate of the separator (7), resulting in a configuration in which all the tabs (7.6), in their operative position inside the heat exchanger, are arranged parallel to the first baffle (1) as described in FIG. 7.

This embodiment places the tabs (7.6) at the end of the separator (7) and is easier to manufacture than the embodiment described in the embodiment shown in FIG. 6 since the bends located at this end are simpler and require tools that are also simpler.

The invention claimed is:

1. A heat exchanger device for EGR systems, wherein in the operative mode the heat exchanger is configured for transferring heat from a first fluid, a hot gas, to a second fluid, a liquid coolant, wherein the exchanger comprises:

a first baffle;

a second baffle;

a tube bundle with a first inner space for the passage of the first fluid, the hot gas, extending along a longitudinal direction X-X' between the first baffle and the second baffle, wherein a first end of the tube bundle is attached to the first baffle and a second end of the tube bundle, opposite the first end, is attached to the second baffle, and wherein the first end of the tube bundle is configured for receiving the hot gas and the second end of the tube bundle is configured for the exit of the cooled gas;

a shell housing the tube bundle, establishing a second space between the tube bundle and said shell for the passage of a liquid coolant which, in the operative mode, covers the tubes of the tube bundle;

a first inlet port for the entry of the liquid coolant to the second space of the inside of the shell;

a second outlet port for the exit of the liquid coolant from the second space of the inside of the shell;

wherein the first inlet port and the second outlet port are located at the end of the second space, according to the longitudinal direction X-X', corresponding to the second baffle;

the shell houses a separator extending according to the longitudinal direction X-X', dividing the second space into a first heat exchange sub-space wherein the tube bundle is housed and a second degassing sub-space;

the first inlet port is in fluid communication with the first sub-space and the second outlet port is in fluid communication with the second sub-space, wherein the first sub-space and the second sub-space are in fluid communication through at least one opening located, according to the longitudinal direction X-X', at the end corresponding to the first baffle, and wherein in the operative mode the flow of the second fluid in the first sub-space is in counter-current with respect to the flow of the first fluid.

2. The heat exchanger device according to claim 1, wherein said heat exchanger is configured for operating in a position such that the longitudinal direction X-X' is in an inclination in the range [−40°, 90°), the horizontal direction being 0° and perpendicular to the direction defined by the direction of gravity, wherein:

for positive angles of inclination, the first baffle is in a higher position than the second baffle according to the direction of gravity, and, for angles of inclination strictly smaller than 90°, the second sub-space is located in an upper position with respect to the first sub-space according to the direction of gravity.

3. The heat exchanger device according to claim 1, wherein the second sub-space is configured for directing the coolant fluid, together with the bubbles generated by boiling in the first sub-space, from the end of the first baffle to the second outlet port.

4. The heat exchanger device according to claim 1, wherein the separator comprises one or more openings along the longitudinal direction X-X'.

5. The heat exchanger device according to claim 1, wherein the separator is only attached to the shell.

6. The heat exchanger device according to claim 1, wherein the separator is spaced from the first baffle, the second baffle, or both baffles.

7. The heat exchanger device according to claim 1, wherein the following conditions are verified:

$$S_p \leq S_d \leq S_h$$

wherein $S_p$ is the cross-section of the outlet port, $S_d$ is the cross-section of the second degassing sub-space, and $S_h$ is the cross-section of the first exchange sub-space.

8. The heat exchanger device according to claim 7, wherein one or both the inequalities is a strict inequality: "<".

9. The heat exchanger device according to claim 1, wherein the separator has at least one tab oriented towards the first sub-space for the purpose of accelerating the coolant fluid.

10. The heat exchanger device according to claim 9, wherein at least one of the at least one tab is located between two tubes of the tube bundle.

11. The heat exchanger device according to claim 9, wherein the at least one tab is a plurality of tabs, wherein said plurality of tabs are positioned such that they define a plane parallel to the first baffle.

12. The heat exchanger device according to claim 9, wherein the at least one tab is located at the end of the separator.

13. The heat exchanger device according to claim 1, wherein the separator comprises at least one protrusion projected towards the second sub-space to favor the collapse of the bubbles.

14. The heat exchanger device comprising a plurality of protrusions according to claim 13, wherein said plurality of protrusions have a labyrinth configuration to prolong the flow path in the second sub-space.

15. An EGR system comprising a heat exchanger device according to claim 1.

* * * * *